US005628071A

United States Patent [19]

Nezer

[11] Patent Number: 5,628,071

[45] Date of Patent: May 13, 1997

[54] COLLAPSIBLE HELMET

[75] Inventor: Shlomo Nezer, Karmiel, Israel

[73] Assignee: Motorika Ltd., Nazeret Ilit, Israel

[21] Appl. No.: 491,197

[22] Filed: Jun. 15, 1995

Related U.S. Application Data

[63] Continuation-in-part of Ser. No. 372,743, Jan. 13, 1995.

[51] Int. Cl.[6] ..... A42B 3/00

[52] U.S. Cl. ..... 2/410; 2/414; 2/424

[58] Field of Search ..... 2/410, 411, 416, 2/417, 418, 419, 420, 421, 422, 424, 425, 6.6, 6.8, 209.11, 205, 202, 171.03, 8

[56] References Cited

U.S. PATENT DOCUMENTS

| | | | |
|---|---|---|---|
| 1,602,727 | 10/1926 | Turner . | |
| 2,277,994 | 3/1942 | Roberts . | |
| 2,679,046 | 5/1954 | Dye . | |
| 2,758,306 | 8/1956 | Grancsay et al. . | |
| 2,861,274 | 11/1958 | Stuart et al. | 2/410 |
| 3,005,203 | 10/1961 | Aileo . | |
| 3,026,525 | 3/1962 | Gyorfy . | |
| 3,082,428 | 3/1963 | Zbikowski . | |
| 3,153,792 | 10/1964 | Marietta . | |
| 3,183,522 | 5/1965 | Groot . | |
| 3,190,973 | 6/1965 | Aileo . | |
| 3,197,784 | 8/1965 | Carlisle . | |
| 3,242,500 | 3/1966 | Derr . | |
| 3,451,066 | 6/1969 | Shears et al. . | |
| 3,470,564 | 10/1969 | Aileo . | |
| 3,513,482 | 5/1970 | Holden . | |
| 3,514,787 | 6/1970 | Kennedy . | |
| 3,541,611 | 11/1970 | Beguin . | |
| 3,596,288 | 8/1971 | Marchello . | |
| 3,786,519 | 1/1974 | Aileo . | |
| 3,943,572 | 3/1976 | Aileo . | |
| 3,987,495 | 10/1976 | Holley . | |
| 3,991,422 | 11/1976 | Saotome . | |
| 4,062,067 | 12/1977 | Franzen . | |
| 4,091,470 | 5/1978 | Ryunoshin . | |
| 4,291,417 | 9/1981 | Pagano . | |
| 4,516,274 | 5/1985 | Buckland . | |
| 4,587,676 | 5/1986 | Estadella . | |
| 4,607,397 | 8/1986 | Laxo . | |
| 4,827,537 | 5/1989 | Villa . | |
| 4,843,642 | 7/1989 | Brower . | |
| 4,885,806 | 12/1989 | Heller . | |
| 4,937,888 | 7/1990 | Straus . | |

FOREIGN PATENT DOCUMENTS

| | | | |
|---|---|---|---|
| 279086 | 8/1988 | European Pat. Off. | 2/410 |
| 996612 | 5/1945 | France . | |
| 95937 | 8/1923 | Germany | 2/414 |
| 1053195 | 3/1959 | Germany | 2/410 |
| 2324 686 | 5/1973 | Germany . | |
| 6-192907A | 7/1994 | Japan . | |
| 6192906 | 7/1994 | Japan | 2/410 |
| 524059 | 7/1940 | United Kingdom . | |
| 2220556 | 1/1990 | United Kingdom . | |

*Primary Examiner*—Michael A. Neas
*Attorney, Agent, or Firm*—Mark M. Friedman

[57] ABSTRACT

A collapsible helmet including a left arched member and a right arched member, each of the left and right arched members has a front portion and a rear portion, the front portions of the left and right arched members being hingedly attached at a front attachment point and the rear portions of the left and right arched members being hingedly attached at a rear attachment point, thereby forming a substantially elliptic headcover surrounding the left and the right head hemispheres of a wearer when the helmet being deployed in its operative position, and a middle arched member, the middle arched member has a front portion and a rear portion, the front portion of the middle arched member being hingedly attached at the front attachment point to the left and right arched members, the rear portion of the middle arched member being hingedly attached at the rear attachment point to the left and right arched members, the middle arched member extending longitudinally across the crown of a wearer when the helmet being deployed in its operative position so as to define a head protecting shell and lying substantially co-centered with said left and right arched members, when the helmet being deployed in its folded inoperative position so as to define a compact layered arched shaped package.

21 Claims, 8 Drawing Sheets

COLLAPSIBLE HELMET

This is a continuation in part of U.S. patent application Ser. No. 08/372,743, filed Jan. 13, 1995.

FIELD AND BACKGROUND OF THE INVENTION

The present invention relates to helmets in general and in particular to collapsible helmets including a number of segments hinged in a manner movable between an expanded operative position and a folded inoperative position.

Personnel engaged in occupations or activities with high levels of danger and therefore, high risk for accidents, are required to wear headgear to protect the wearers' heads against impact. Such headgear typically provides one of two levels of protection depending on which parts of the wearers' head are to be protected. The two levels are: (a) absorbing the impact energy which can be developed by falling or impact on the helmet; and (b) preventing penetration of sharp objects into the user's head through the activity.

Usually the safety standards are separated into these two levels. For dangerous activities, such as motorcycling, industry, construction, etc., both levels are needed. For less dangerous activities, such as bicycling, skating and other sports and games, the impact absorbing is the main requirement. Moreover, in these activities the wearer uses the helmet for long time periods and while under stress during the activity. For that reason it is recommended to provide ventilation slots and gaps, which is absolutely forbidden in helmets designed for dangerous activities.

There are two types of helmet constructions: the 'half helmet' for protecting the crown of the wearer and the 'full helmet' for protecting both the crown and the face of teh wearer.

Such headgear typically includes a rigid shell helmet with a flexible internal rigging for supporting the shell in spaced relation to the wearer's head and thus absorbing the impact without hurting the wearer's head. Rigid shell helmets suffer from a number of disadvantages. First, that they are relatively heavy when worn. Second, that they are inconvenient to carry when not in use. And third, they are inconvenient to store when not in use.

A number of collapsible helmets have been suggested to overcome some of these disadvantages as now described hereinbelow:

U.S. Pat. No. 3,987,495 to Holley describes a motorcycle helmet having two halves which may be detachably secured together for use or separated for easy storage. The halves come together at the central vertical plane that extends from the front of the helmet to the rear and thereby divides it into a right half and a left half that are mirror images of each other.

U.S. Pat. No. 4,587,676 to Estadella describes a collapsible helmet including two supplemental portions which are mutually joined at two pivot points. The supplemental portions rotate about the rotating points and engage one inside the other in a folded position and engage along a line which extends parallel to a line which defines the bottom perimeter of the helmet.

U.S. Pat. No. 4,827,537 to Villa describes a helmet having a plurality of segments which are interhinged for swinging movement between an expanded operating position and a collapsed non-operating position. The segments have cooperating ribs and recesses to maintain them in the expanded operating position.

U.S. Pat. No. 4,091,470 to Ryunishin describes a collapsible helmet composed of several inwardly curved fan-shaped sections. The helmet can be folded into a nested position so as to assume the size of one of the sections.

Similar helmets are disclosed in U.S. Pat. No. 3,991,422 to Saotome and U.S. Pat. No. 4,607,397 to Laxo.

Such developments suffer from a number of disadvantages including that they typically include a large number of elements and complicated mechanisms, they are cumbersome during conversion from their expanded operative positions to their folded inoperative positions and vice versa, and packages formed by the collapsible helmets are large and awkwardly shaped.

Therefore, there is a need for a collapsible helmet which overcomes the disadvantages of conventional collapsible helmets.

SUMMARY OF THE INVENTION

The present invention is for a number of implementations of collapsible helmets for protecting either the crown of a wearer or the crown and the face of a wearer.

Hence, there is provided according to the teachings of the first embodiment of the present invention, a collapsible helmet comprising: (a) a substantially elliptic headband having a left side portion and a right side portion; and (b) an arch-shaped strap hingedly attached to the left side portion and the right side portion, the strap extending laterally across the crown of a wearer when deployed in its substantially upright operative position so as to define a head protecting shell and lying substantially co-planar with the headband when deployed in its folded inoperative position so as to define a compact package.

According to a further feature of the first embodiment of the present invention, the strap is exterior to the headband.

According to a still further feature of the first embodiment of the present invention, the strap is interior to the headband.

According to a yet still further feature of the first embodiment of the present invention, the headband includes a forehead portion and a nape portion, the helmet further comprising a pair of arch-shaped ribs hingedly attached to the forehead portion and to the nape portion, the pair of ribs extending longitudinally across the crown of a wearer when deployed in their substantially upright operative positions and lying co-planar with the headband when deployed in their folded inoperative positions.

According to a yet still further feature of the first embodiment of the present invention, the pair of ribs are interior to the headband.

According to a yet still further feature of the first embodiment of the present invention, the pair of ribs are exterior to the headband.

According to a yet still further feature of the first embodiment of the present invention, the helmet further comprising a stopper deployed either at the forehead portion or at the nape portion for stopping the ribs in a spaced apart arrangement one from the other when deployed in their the operative positions.

According to a yet still further feature of the first embodiment of the present invention, the helmet further comprising an arch-shaped face guard hingedly attached to the headband, the face guard extending laterally across the chin of a wearer when deployed in its substantially downward inclined operative position so as to define a face protecting shield and lying co-planar with the headband when deployed in its folded inoperative position so as to substantially lie flush with the compact package.

According to a yet still further feature of the first embodiment of the present invention, the face guard is exterior to the headband.

According to the teachings of the second embodiment of the present invention there is provided a collapsible helmet comprising: (a) a substantially elliptic headcover having a left arched member and a right arched member hingedly connected to one another at a front and a rear attachment points, the headcover surrounding the left and the right head hemispheres of a wearer when the helmet being deployed in its operative position; and (b) a middle arched member connected to the headcover at the front and the rear attachment points and extending longitudinally across the crown of a wearer when the helmet being deployed in its operative position so as to define a head protecting shell, and lying substantially co-centered with the left and right arched members, when the helmet being deployed in its folded inoperative position so as to define a compact layered arch-shaped package.

According to a further feature of the second embodiment of the present invention, the left arched member is exterior to the right arched member.

According to a still further feature of the second embodiment of the present invention the middle arched member is exterior to the right arched member.

According to a yet still further feature of the second embodiment of the present invention the middle arched member is interior to the right arched member.

According to a yet still further feature of the second embodiment of the present invention the middle arched member is exterior to the left arched member.

According to a yet still further feature of the second embodiment of the present invention the middle arched member is interior to the left arched member.

According to a yet still further feature of the second embodiment of the present invention the left arched member is interior to the right arched member.

According to a yet still further feature of the second embodiment of the present invention the helmet further comprising an additional arched member hingedly attached at an additional attachment point to the middle arched member and extending laterally across the crown of the wearer when the helmet being deployed in its operative position and lying substantially co-centered with the left, right and middle arched members when the helmet being deployed in its folded inoperative position, the attachments of the additional arched member the left and right arched members is releasable, thereby when the helmet being deployed in its the operative position, the releasable attachment being employed for stopping the arched members in a spaced apart arrangement one from the other.

According to a yet still further feature of the second embodiment of the present invention the helmet alternatively of additionally comprising flexible straps connecting the middle arched member with the left and right arched members, the flexible straps being stretched when the helmet being deployed in its operative position and folded amongst any of the arched members when the helmet being deployed in its folded inoperative position.

According to a yet still further feature of the second embodiment of the present invention each of the arched members includes a front portion and a rear portion, the helmet further comprising a stopper deployed either at the front portions or at the rear portions for stopping the arched members in a spaced apart arrangement one from the other when deployed in their operative positions.

According to a yet still further feature of the second embodiment of the present invention one of the left and right arched members being larger than the other, so as the left and right arched members being co-centered when the helmet deployed its folded inoperative position.

According to a yet still further feature of the second embodiment of the present invention the left and right arched members being substantially similarly sized and curved so as the left and right arched members being coincided when the helmet deployed its folded inoperative position.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
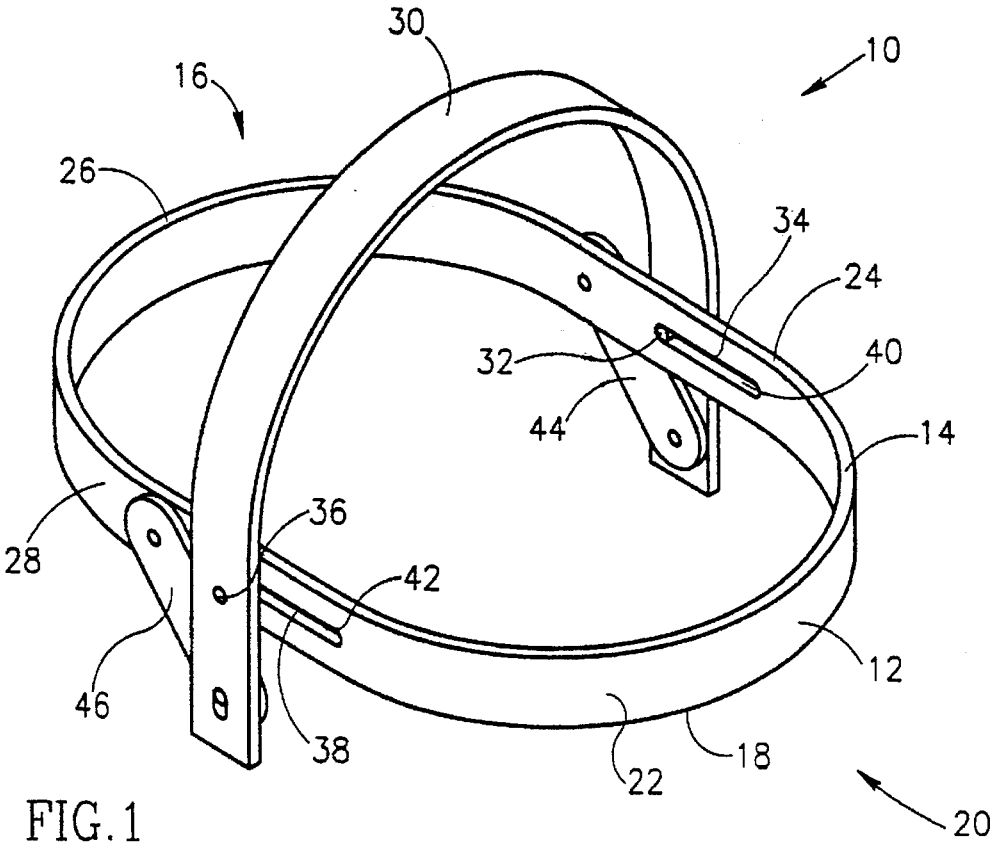
FIG. 1 shows a perspective view of a first preferred embodiment of a helmet including a headband and an arch-shaped strap, constructed and operative according to the teachings of the present invention, deployed in its upright operative position.

The present invention is of a number of implementations of collapsible helmets for protecting either the crown of a wearer or the crown and the face of a wearer.

The principles and operation of the collapsible helmets of the present invention may be better understood with reference to the drawings and the accompanying description.

Broadly speaking, the collapsible helmets of the present invention are designed to provide protection to the head of a wearer by means of one or more relatively narrow segments. In particular, the collapsible helmets of the present invention in a first preferred embodiment include a headband and a rigid arch-shaped strap extending laterally across the crown of a wearer when deployed in its upright operative position and/or a pair of rigid arch-shaped ribs extending longitudinally across the crown of a wearer when deployed in their upright operative positions.

It is a further feature of the first preferred embodiment of the present invention that the segments are hingedly attached to the headband such that they lie co-planar with the headband when deployed in their folded inoperative positions.

In a second preferred embodiment the collapsible helmets of the present invention include, a left arched member and a right arched member being hingedly attached at a front and a rear attachment points, thereby forming a substantially elliptic headcover surrounding the left and the right head hemispheres of a wearer when the helmet being deployed in its operative position; and a middle arched member being hingedly attached at the front and rear attachment points to the left and right arched members, extending longitudinally across the crown of a wearer when the helmet being deployed in its operative position so as to define a head protecting shell, and lying substantially co-centered with the left and right arched members, when the helmet being deployed in its folded inoperative position so as to define a compact layered arch-shaped package.

Furthermore, the helmets can also include a face guard for protecting the chin of a wearer when deployed in its downward inclined operative position.

Thus, it can be readily appreciated that the collapsible helmets according to the teachings of the present invention provide protection against head on impacts and side on impacts. Therefore, it can also be readily appreciated that the collapsible helmets of the present invention provide, in effect, near to or the equivalent degree of protection as conventional continuous shell helmets notwithstanding that considerably less of the total area of the wearer's head is covered.

Referring now to the drawings, FIGS. 1–6 depict a collapsible helmet of the first embodiment, generally designated 10, constructed and operative according to the teachings of the present invention. Collapsible helmet 10 is typically fabricated from aluminum, a durable composite material, plastic, and the like. Collapsible helmet 10 can be provided as a half-helmet for protecting the crown of a wearer or as a full helmet for protecting both the crown and the face of a wearer as will become apparent hereinbelow. It should be noted that FIGS. 1–6 only depict the skeleton of collapsible helmet 10 and that a fully made up collapsible helmet 10 includes a flexible outer coveting, a flexible internal rigging for supporting a helmet in a spaced relation relative to a wearer's head, fastening straps for tightening a helmet on a wearer's head, locking mechanisms for locking the helmet in its expanded operative position and its folded inoperative position, and the like.

Helmet 10 includes a substantially elliptic headband 12 having an upper rim 14 defining an upper plane, generally designated 16, and a lower rim 18 defining a lower plane, generally designated 20. For the sake of convenience, headband 12 is divided into four portions as follows: a forehead portion 22, a left side portion 24, a nape portion 26 and a right side portion 28. The distance between forehead portion 22 and nape portion 26 defines the long axis of headband 12 whereas the distance between left side portion 24 and right side portion 28 defines the short axis of headband 12.

Rims 14 and 18 are generally parallel and therefore upper plane 16 and lower plane 20 are preferably parallel. However, it should be noted that rims 14 and 18 can include protrusions and recesses. Furthermore, rims 14 and 18 can be fabricated such that upper plane 16 and lower plane 20 have a slight forward or rearward convergence therebetween.

Helmet 10 also includes at least one rigid arch-shaped strap 30 which can be articulated relative to headband 12 to one of two positions: First, a substantially upright operative position in which strap 30 extends laterally across the crown of a wearer, thereby defining a head protecting shell, as shown in FIG. 1. And second, a folded inoperative position in which strap 30 lies co-planar with upper plane 16 and lower plane 20 defined by rims 14 and rims 18 of headband 12, thereby forming a compact package, as shown in FIG. 2.

In particular, arch-shaped strap 30 includes a left pin 32 hingedly attached to left side portion 24 at an attachment point 34 and a right pin 36 hingedly attached to right side portion 28 at an attachment point 38. Attachment points 34 and 38 are laterally arranged and preferably implemented as slots 40 and 42, respectively, such that strap 30 can be deployed at opposite ends of slots 40 and 42 to facilitate the conversion of helmet 10 from a head protecting shell to a relatively thin compact package. As shown, strap 30 is deployed toward nape portion 26 along slots 40 and 42 when deployed in its substantially upright operative position and is deployed toward forehead portion 22 when deployed in its folded inoperative position.

Helmet 10 preferably includes a pair of spring-biased locking links 44 and 46 adapted to maintain helmet 10 in either its substantially upright operative position or its folded inoperative position. Links 44 and 46 typically include pins reciprocating in slots provided in extensions to the left side and right side of arch-shaped strap 30, respectively.

Figure 2:
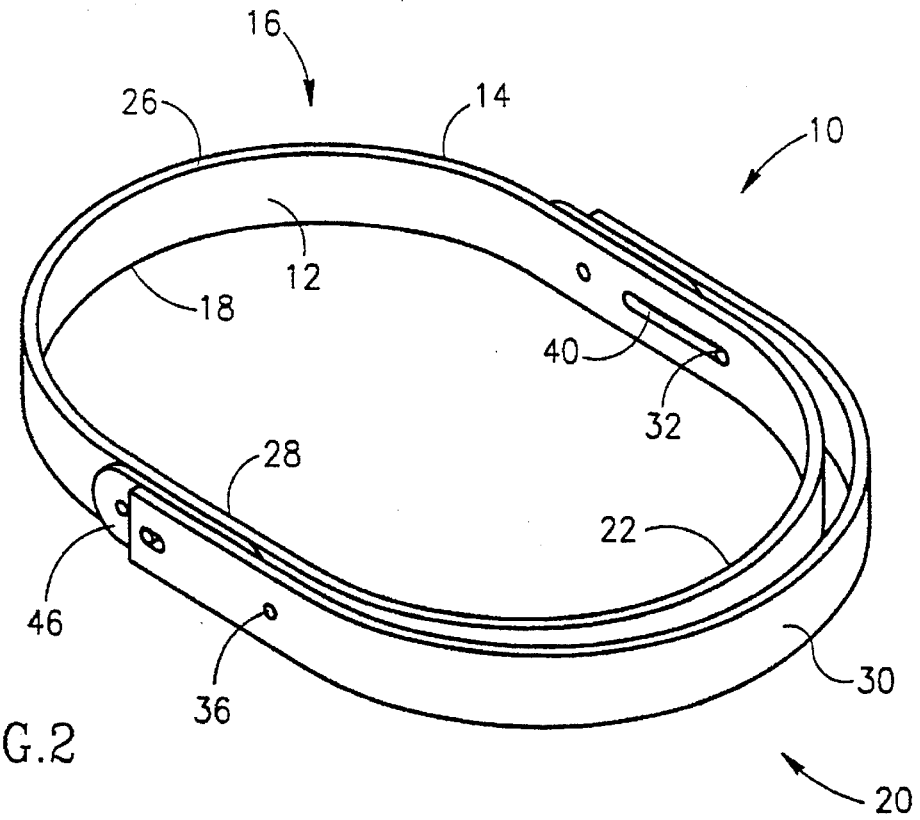
FIG. 2 shows a perspective view of the helmet of FIG. 1 in which the arch-shaped strap is deployed its folded inoperative position.

FIGS. 1 and 2 depict arch-shaped strap 30 as being exterior to headband 12, however, arch-shaped strap 30 can equally be interior to headband 12. In the case that arch-shaped strap 30 is exterior to headband 12, the curvature of strap 30 is less than the curvature of forehead portion 22 and the distance between the ends of arch-shaped strap 30 is greater than the short axis of headband 12.

Figure 3:
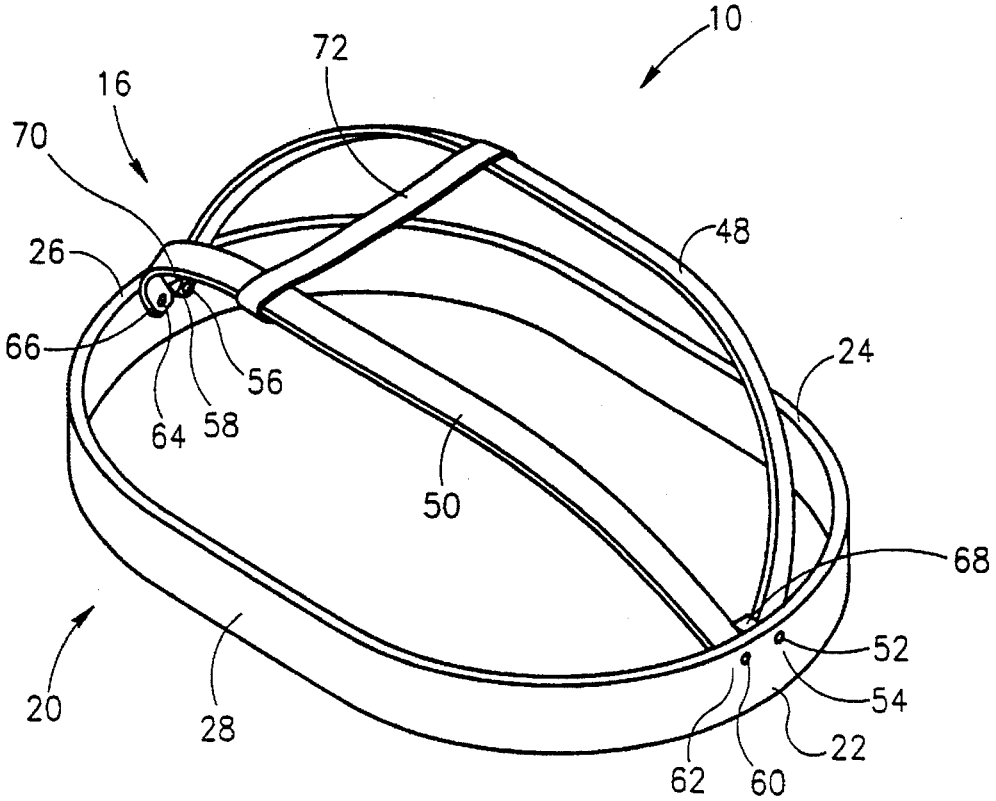
FIG. 3 shows a perspective view of a helmet including a pair of arch-shaped ribs deployed in their upright operative positions.
Figure 4:
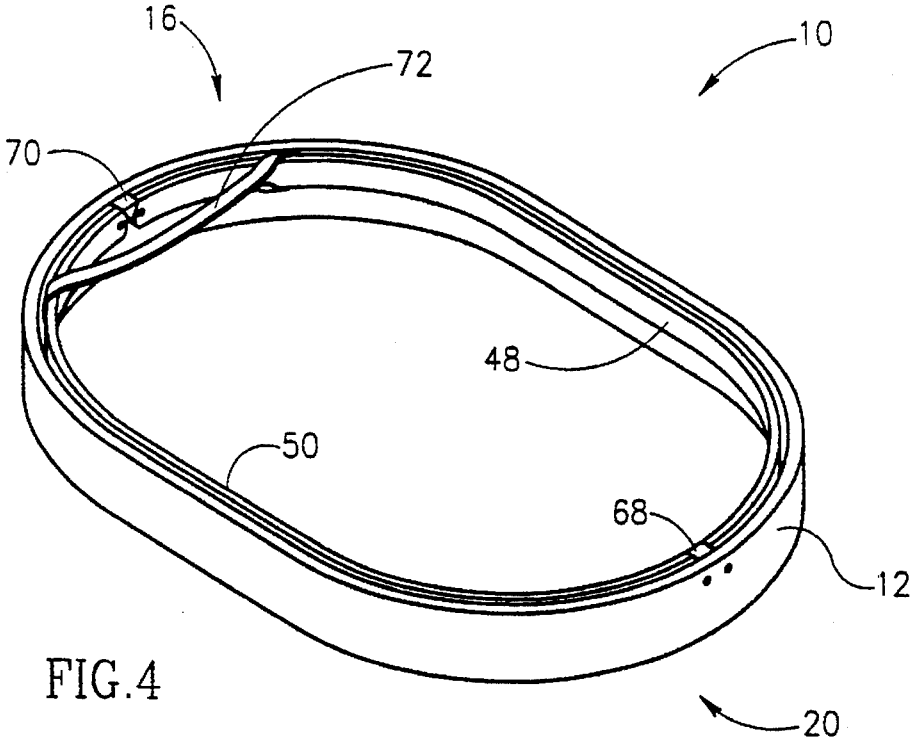
FIG. 4 shows a perspective view of the helmet of FIG. 3 in which the pair of arch-shaped ribs are deployed in their folded inoperative positions.

With reference now to FIGS. 3 and 4, as an alternative to or as a supplement to arch-shaped strap 30, helmet 10 can further include at least one pair of rigid arch-shaped ribs 48 and 50 which can be articulated relative to headband 12 to one of two positions: First, substantially upright operative positions in which ribs 48 and 50 extend longitudinally across the crown of a wearer, thereby defining a head protecting shell, as shown in FIG. 3. And second, folded inoperative positions in which ribs 48 and 50 lie co-planar with upper plane 16 and lower plane 20 defined by rims 14 and rims 18 of headband 12, thereby forming a relatively thin compact package, as shown in FIG. 4. In their substantially upright operative positions, arch-shaped rims 48 and 50 provide longitudinal rigidity against impacts.

In particular, arch-shaped rib 48 includes a front pin 52 hingedly attached to forehead portion 22 at an attachment point 54 and a rear pin 56 hingedly attached to nape portion 26 at an attachment point 58. In a similar fashion, arch-shaped rib 50 includes a front pin 60 hingedly attached to forehead portion 22 at an attachment point 62 and a rear pin 64 hingedly attached to nape portion 26 at an attachment point 66. Ribs 48 and 50 preferably have a spaced apart configuration relative to headband 12 in their substantially upright operative position which is achieved by means of a pair of stoppers 68 and 70 employed at forehead portion 22 and nape portion 26, respectively, and a sliding belt 72.

FIGS. 3 and 4 depict arch-shaped ribs 48 and 50 as being interior to headband 12, however, ribs 48 and 50 can equally be exterior to headband 12. In the case that arch-shaped ribs 48 and 50 are interior to headband 12, the curvature of ribs 48 and 50 is greater than the curvature of left side and right side portions 24 and 28 and the distance between the ends of arch-shaped ribs 48 and 50 is less than the long axis of headband 12.

It should be noted that when arch-shaped ribs 48 and 50 are used as a supplement to arch-shaped strap 30, they are typically employed in an opposite sense relative to arch-shaped strap 30. In other words, arch-shaped ribs 48 and 50 are interior to headband 12 when arch-shaped strap 30 is exterior thereto. And, conversely, arch-shaped ribs 48 and 50 are exterior to headband 12 when arch-shaped strap 30 is interior thereto.

Figure 5:
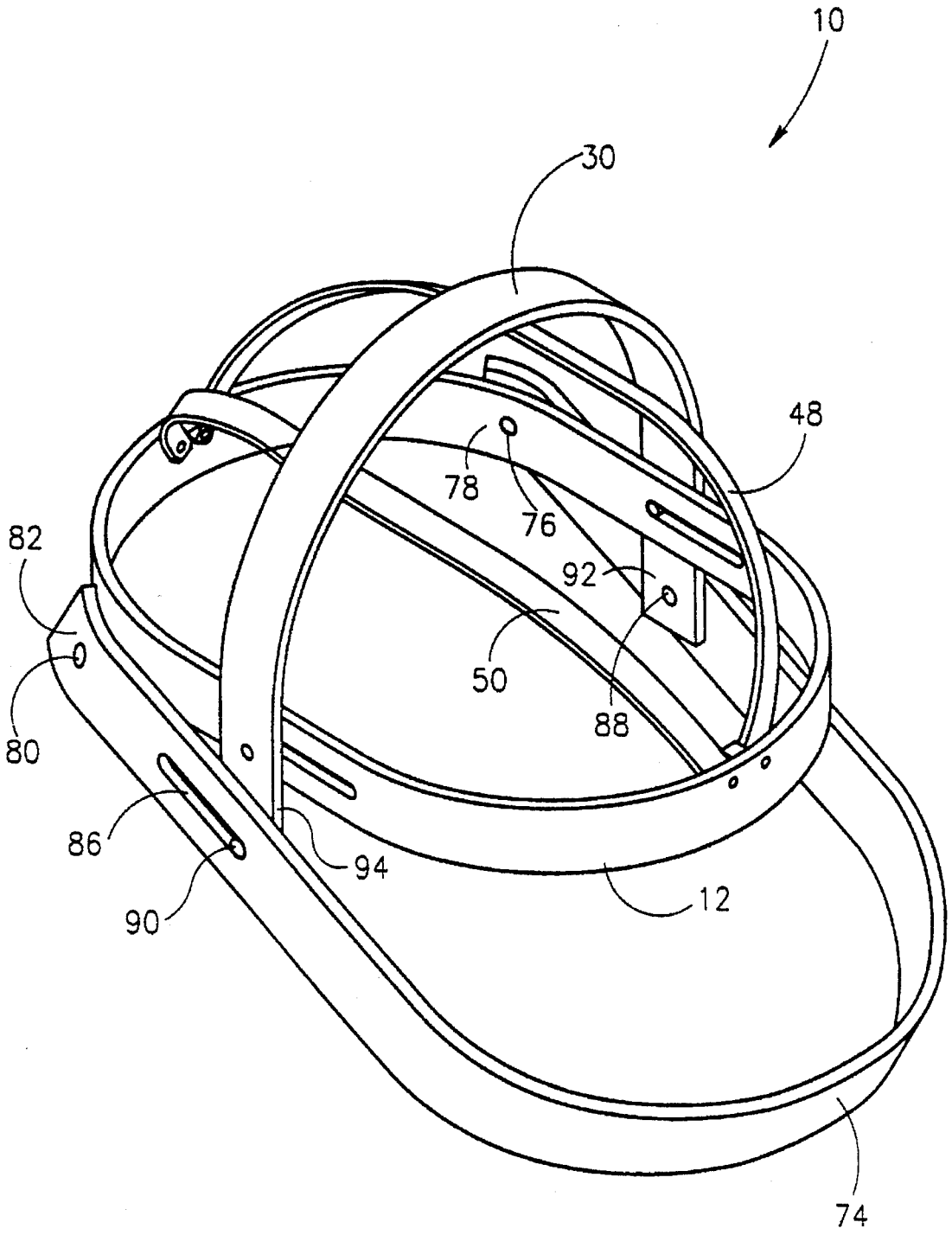
FIG. 5 shows a perspective view of the helmet of FIG. 3 including a face guard deployed in its downward inclined operative position.
Figure 6:
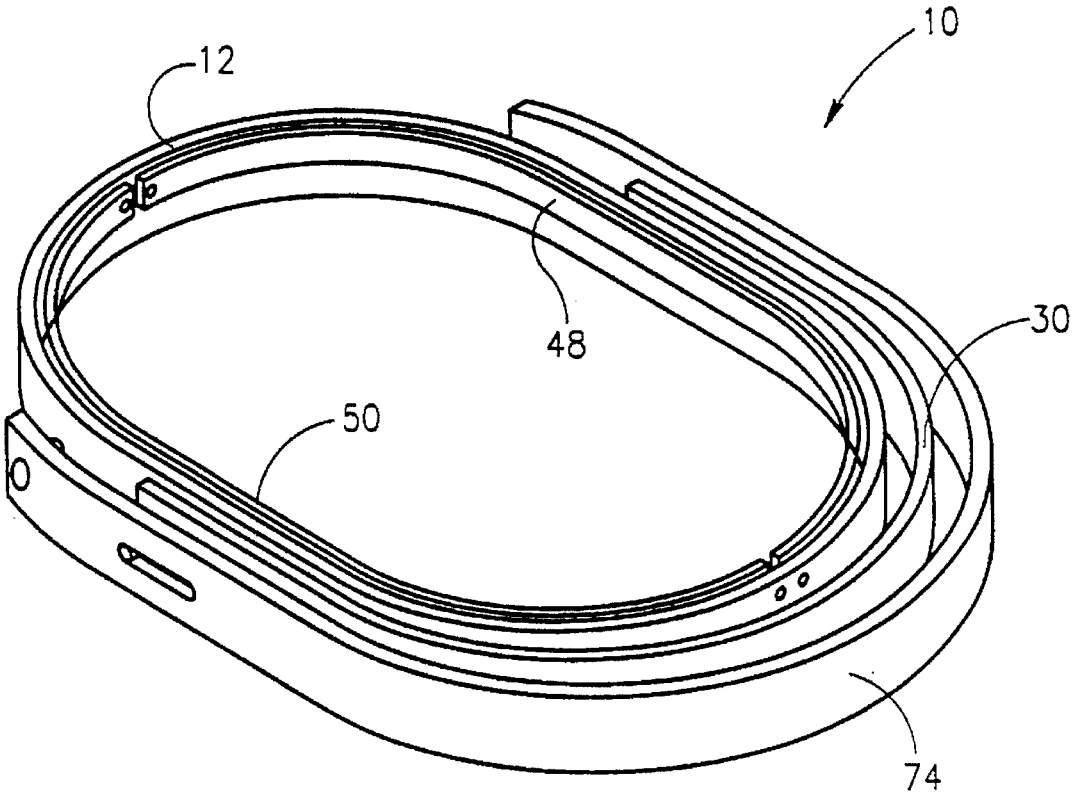
FIG. 6 shows a perspective view of the helmet of FIG. 5 in which the face-guard is deployed in its folded inoperative position.

With reference now to FIGS. 5 and 6, helmet 10 can further include an arch-shaped face guard 74 which can be articulated relative to headband 12 to one of two positions: First, a substantially downward inclined operative position in which face guard 74 extends laterally across the chin of a wearer, thereby defining a face protecting shield, as shown in FIG. 5. And second, a folded inoperative position in which face guard 74 lies co-planar with upper plane 16 and lower plane 20 defined by rims 14 and rims 18 of headband 12 so as to lie flush with the relatively thin compact package achieved by either strap 30 or ribs 48 and 40, as shown in FIG. 6.

In the present case, arch-shaped face guard 74 includes a left pin 76 hingedly attached to left side portion 24 at an attachment point 78 and a right pin 80 hingedly attached to right side portion 28 at an attachment point 82. Furthermore, face guard 74 includes a pair of laterally arranged slots 84 (not shown) and 86, which are used to articulate face guard 74 relative to headband 12 by means of pins 88 and 90, respectively, provided on extensions 92 and 94, respectively, to strap 30. Hence, pins 88 and 90 reciprocate between the front ends of slots 84 and 86 and the rear ends of slots 84 and 86 in the following manner. First, when face guard 74 is deployed into its substantially downward inclined operative position, pins 88 and 90 urge strap 30 into its upright operative position. And second, when face guard 74 is deployed into its folded inoperative position, pins 88 and 90 urge strap 30 into its folded inoperative position.

As a space saving measure, it should be noted that helmet 10 can be configured such that strap 30 lies to the rear of headband 12 and face guard 74 lies to the front of headband 12 when deployed in their folded inoperative positions.

FIGS. 7–11 depict a collapsible helmet of the second preferred embodiment, generally designated 100, constructed and operative according to the teachings of the present invention described hereinbelow. Collapsible helmet 100 is typically fabricated from aluminum, a durable composite material, plastic, and the like. Collapsible helmet 100 is provided as a half-helmet for protecting the crown of a wearer. It should be noted that FIGS. 7–11 principally depict the skeleton of collapsible helmet 100 and that a fully made up collapsible helmet 100 may include a flexible outer covering, a flexible internal rigging for supporting a helmet in a spaced relation relative to a wearer's head, a flexible internal padding to soften the impact in case of an accident, fastening straps 103 for tightening a helmet on a wearer's head, locking mechanisms for locking the helmet in its expanded operative position and its folded inoperative position, and the like.

Helmet 100 includes a left arched member, generally designated 102 and a right arched member generally designated 104, each of left 102 and right 104 arched members has a front portion, 106 and 108, respectively, and a rear portion, 110 and 112, respectively. Front portions 106 and 108 are hingedly connected to one another at a front attachment point 114 and at a rear attachment point 116, thereby forming a substantially elliptic headcover 118 surrounding the left and the right head hemispheres of a wearers head when the helmet being deployed in its operative position. A middle arched member, generally designated 120 and has a front portion 122 hingedly attached at front attachment point 114 to left 102 and right 104, and a rear portion 124 hingedly attached at rear attachment point 116 to left 102 and right 104 arched members, thereby, the middle arched member 120 is extending longitudinally across the crown of a wearer when the helmet is deployed in its operative position so as to define a head protecting shell.

Figure 7:
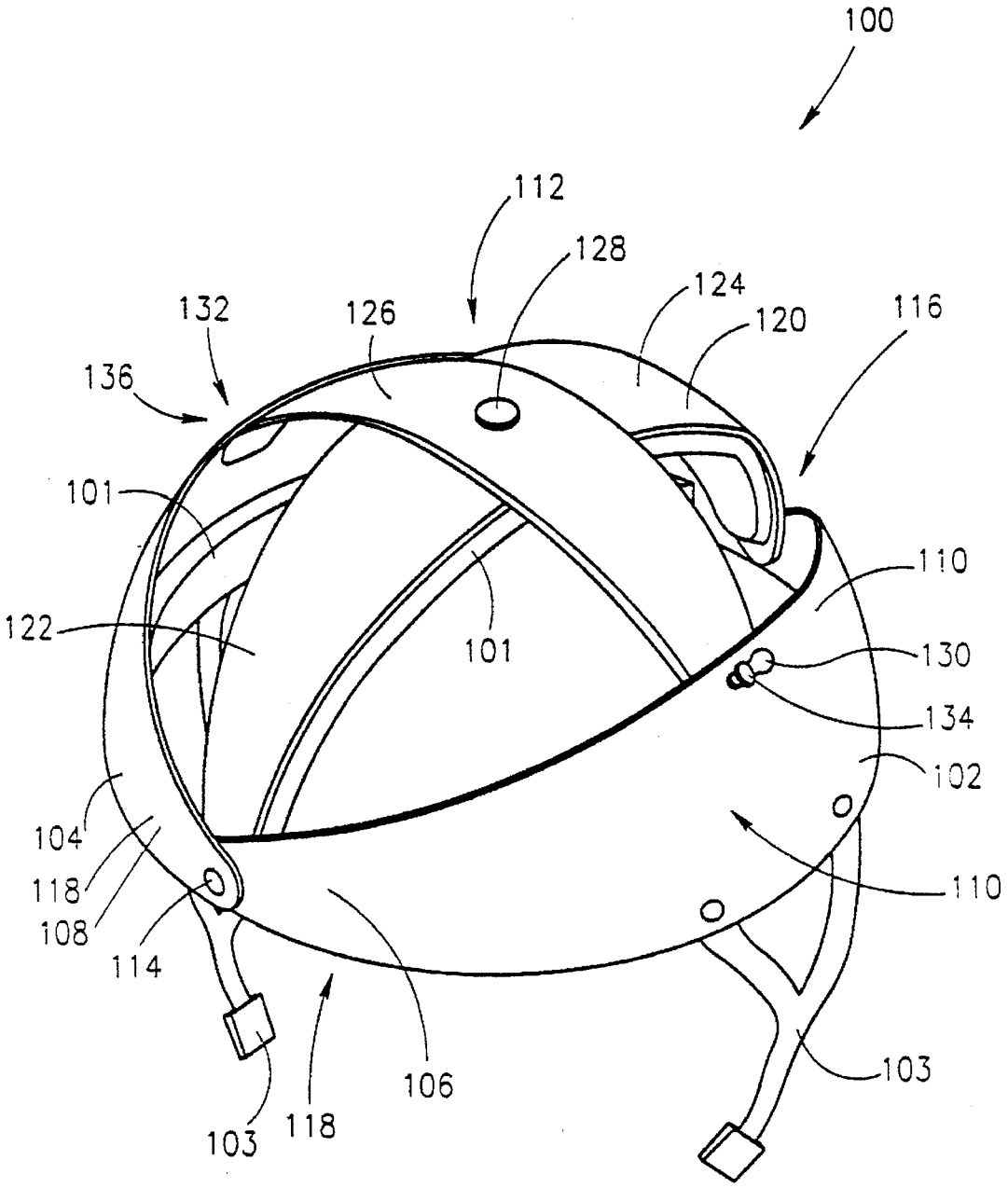
FIG. 7 shows a perspective view of a second preferred embodiment of a helmet including a left, a right, a middle and an additional arched members, constructed and operative according to the teachings of the present invention, deployed in its upright operative position.
Figure 8:
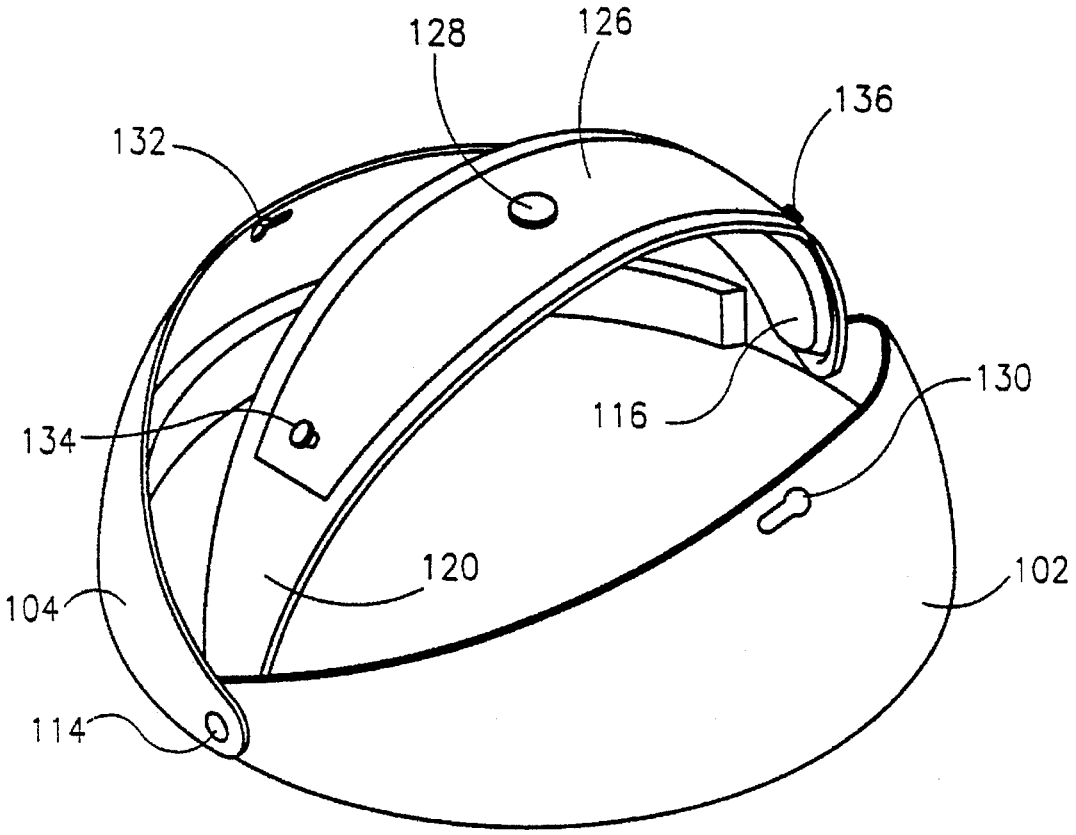
FIG. 8 shows a perspective view of the helmet of FIG. 7 in which the additional arched member is deployed its folded inoperative position.
Figure 9:
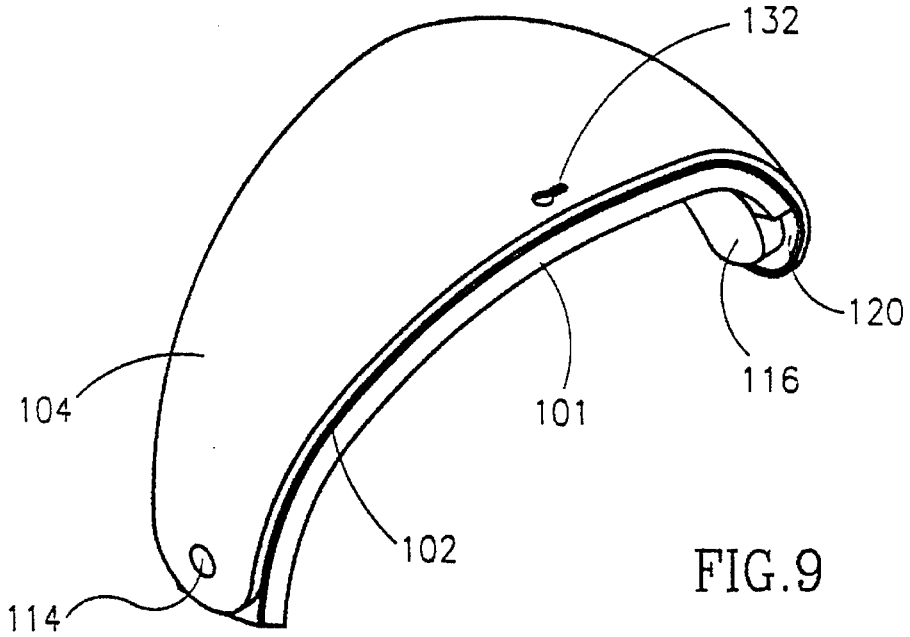
FIG. 9 shows a perspective view of the helmet of FIG. 7 and 8 in which the left and right arched members are deployed their folded inoperative position.

It should be noted that few possible arrangements exist for arched members 102, 104 and 120. In a first possibility, as shown in FIGS. 7–9, right arched member 104 is exterior to left arched member 102, itself exterior to middle arched member 120. In a second possibility right arched member 104 is interior to left arched member 102, itself interior to middle arched member 120. In a third possibility right arched member 104 is exterior to left arched member 102, itself interior to middle arched member 120. In a fourth possibility right arched member 104 is interior to left arched member 102, itself exterior to middle arched member 120. In a fifth possibility middle arched member 120 is exterior to right arched member 104, itself exterior to left arched member 102. In a sixth possibility middle arched member 120 is interior to right arched member 104, itself interior to left arched member 102.

As shown in FIG. 7, helmet 100 further includes an additional arched member 126 being hingedly attached via an additional attachment point 128 located substantially at the center of middle arched member 120 to middle arched member 120. Additional arched member 126 extending laterally across the crown of a wearer when helmet 100 being deployed in its operative position. Furthermore, additional arched member 126 is attached in releasable attachments 130 and 132, respectively, to left 102 and right 104 arched members, thereby when helmet 100 being deployed in its operative position, releasable attachments 130 and 132 being employed for stopping arched members 102, 104 and 120 in a spaced apart arrangement one from the other. In particular, additional arched member 120 includes a left pin 134 releasably attached to left arched member 102 at attachment point 130 and a right pin 136 releasably attached to right arched member 104 at attachment point 132. It should be noted that additional arched member 126 can be attached either externally, as shown in FIGS. 7–9, or internally (not shown) relative to middle arched member 120. It should be further noted that additional arched member 126 can be releasably attached either internally, as shown in FIGS. 7–9, or externally (not shown) to either left 102 and right 104 arched members.

As shown in FIGS. 8 and 9, the collapsing process of helmet 100 principally includes two successive steps. As shown in FIG. 8, in the first step, additional arched member 126 is rotated around additional attachment point 128 at substantially 90°, to be oriented co-centered and aligned with middle arched member 120. As shown in FIG. 9, in the following second step, left 102 and right 104 arched members are rotated around front attachment point 114 and rear attachment point 116 at substantially 90°, to be oriented substantially co-centered and aligned with middle arched member 120 and additional arched member 126, thereby when helmet 100 being deployed in its folded inoperative position it acquires a compact layered arch-shaped package.

Figure 10:
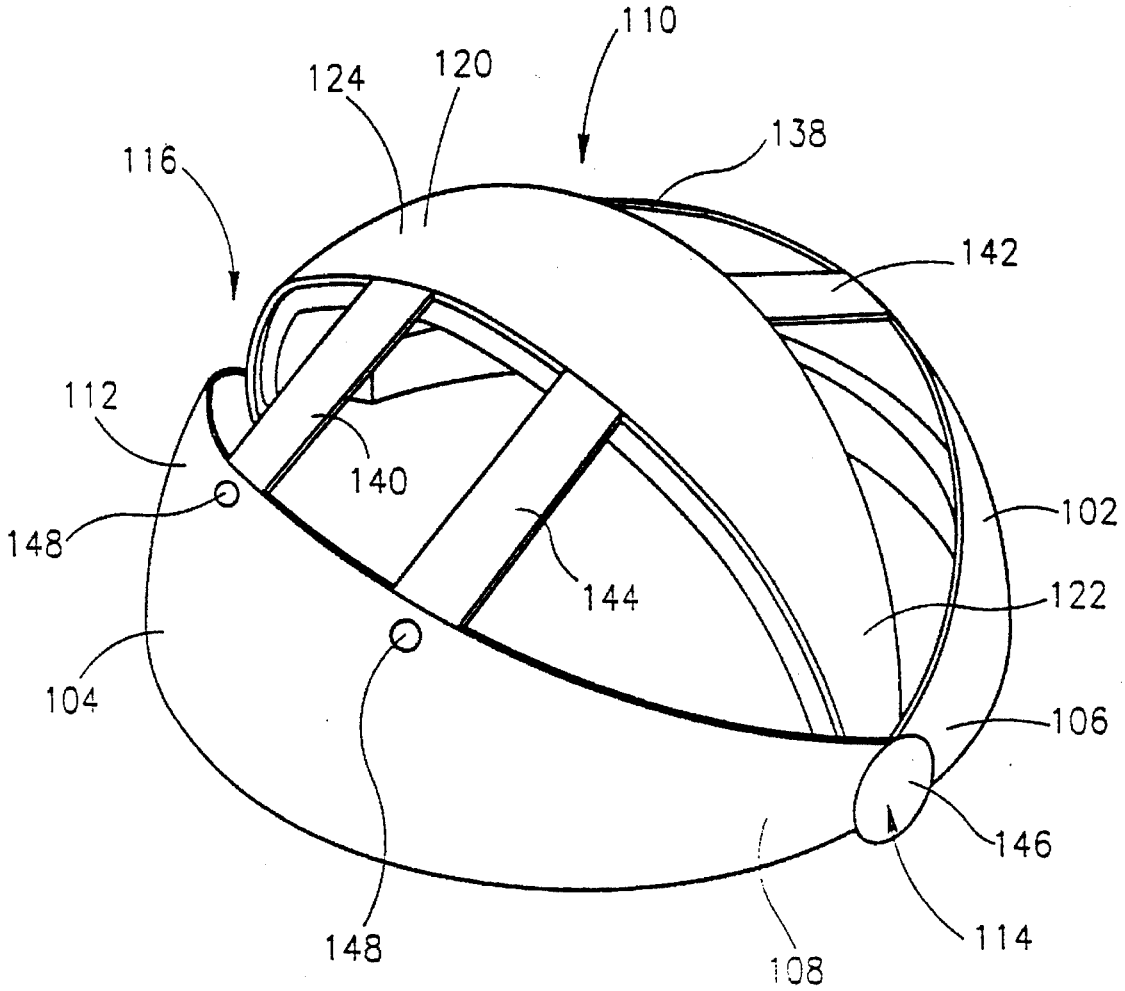
FIG. 10 shows a perspective view of the second preferred embodiment of the helmet including the left, the right and the middle arched members, flexible straps and a locker device constructed and operative according to the teachings of the present invention, deployed in its upright operative position.

As shown in FIG. 10, alternative to additional arched member 126, employed are flexible straps 138 and 140, and flexible straps 142 and 144 attaching rear section 124 of middle arched member 120 and rear sections 110 and 112 of left 102 and right 104 arched members, respectively, and front section 122 of middle arched member 120 and front sections 106 and 108 of left 102 and right 104 arched members, respectively, and a locking mechanism 146 located at from attachment point 114, for stopping arched members 102, 104 and 120 in a spaced apart arrangement one from the other when helmet 100 being deployed in its operative position. It should be noted that various alternative options exist to connect middle arched member 120 and left 102 and right 104 arched members with straps. In a first option one continuous strap is connected in one end to left arched member 102, in its other end to right arched member 104 and in its center to middle arched member 120; in a second option two or more of the above described continuous strap are employed to support arched members 102, 104 and 120; in a third option one or more pairs of straps, of the kind described above (e.g., strap 138 and strap 140 form a pair of straps), are employed to support arched members 102, 104 and 120. It should be further noted that any of the mentioned straps may be connected externally or internally to any of mentioned arched members 102, 104 and 120. Yet, it should be further noted that various engagements such as, for example, pins 148 may be employed to connect any of the mentioned straps to any of the mentioned arched members 102, 104 and 120. Furthermore, it should be noted that locking mechanism 146 may acquire various forms and may be located at different locations, such as for example rear attachment point 116. It should be further noted that any of the mentioned straps could be employed together with additional arched member 126 for stopping arched members 102, 104 and 120 in a spaced apart arrangement one from the other when helmet 100 being deployed in its operative position.

Figure 11:
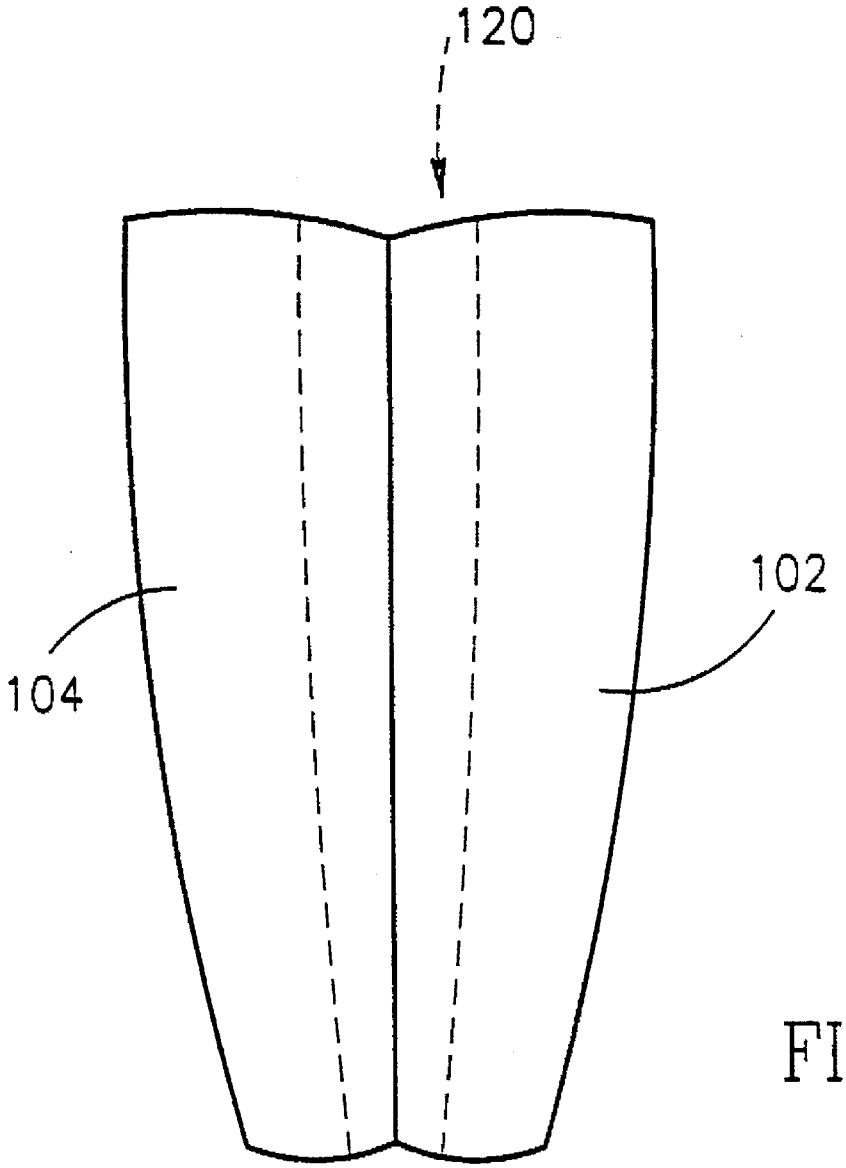
FIG. 11 shows a perspective view of the helmet of FIG. 10 in which it is deployed its folded inoperative position.

As further shown in FIG. 10, a somewhat different arrangement for left 102 and right 104 arched members may exist. In this different arrangement left 102 and right 104 arched members are of a substantially similar size and curvature, therefore, as shown in FIG. 11, when helmet 100 is deployed its folded inoperative position, left 102 and right 104 arched members coincide. It should be noted that in this different arrangement middle arched member 120 may be positioned internally, as shown in FIGS. 10 and 11, or externally (not shown) to left 102 and right 104 arched members.

All in all, it can be readily appreciated that the collapsible helmet of the present invention has several important advantages over the collapsible helmets described in the prior art. First, the collapsible helmet is more rigid than most conventional collapsible helmets. Second, the collapsible helmet includes far less elements and does not require any complicated mechanism. Third, the helmet can be readily converted from its expanded operative position to its folded inoperative position and vice versa. And fourth, the compact package formed by the helmet in its folded inoperative state is generally smaller than the packages formed by prior art collapsible helmets and has a regular relatively thin elliptic shape alternatively a "banana" shape suitable to be attached to a belt worn around wearers' hips, rather than some awkward shaped package formed by prior art collapsible helmets.

While the invention has been described with respect to a limited number of embodiments, it will be appreciated that many variations, modifications and other applications of the invention may be made.

What is claimed is:

1. A collapsible helmet comprising:

(a) a left arched member and a right arched member, each of said left and right arched members having a front portion and a rear portion, said front portions of said left and right arched members being hingedly attached at a front attachment point and said rear portions of said left and right arched members being hingedly attached at a rear attachment point, thereby forming a substantially elliptic headcover, said headcover surrounding the left and the right head hemispheres of a wearer when the helmet is deployed in its operative position;

(b) a middle arched member, said middle arched member having a front portion and a rear portion, said front portion of said middle arched member being hingedly attached at said front attachment point to said left and right arched members, said rear portion of said middle arched member being hingedly attached at said rear attachment point to said left and right arched members, said middle arched member extending longitudinally across the crown of a wearer when the helmet is deployed in its said operative position so as to define a head protecting shell; and (c) at least one flexible strap connecting said middle arched member with said left and right arched members, said at least one flexible strap being stretched when the helmet being deployed in said operative position, wherein said middle, said left and said right arched members assume a folded inoperative position in which they overlap form a compact, layered, arch-shaped package, with said at least one flexible strap folded amongst any of said arched members.

2. The helmet as in claim 1 wherein said left arched member is exterior to said right arched member.

3. The helmet as in claim 2 wherein said middle arched member is exterior to said right arched member.

4. The helmet as in claim 2 wherein said middle arched member is interior to said right arched member.

5. The helmet as in claim 2 wherein said middle arched member is exterior to said left arched member.

6. The helmet as in claim 2 whereto said middle arched member is interior to said left arched member.

7. The helmet as in claim 1 wherein said left arched member is interior to said right arched member.

8. The helmet as in claim 7 wherein said middle arched member is exterior to said right arched member.

9. The helmet as in claim 7 wherein said middle arched member is interior to said right arched member.

10. The helmet as in claim 7 wherein said middle arched member is interior to said left arched member.

11. The helmet as in claim 7 wherein said middle arched member is interior to said left arched member.

12. The helmet as in claim 1, further comprising an additional arched member, said additional arched member being hingedly attached via an additional attachment point to said middle arched member, said additional arched member extending laterally substantially across the crown of a wearer when the helmet being deployed in its said operative position and lying substantially co-centered with said left, right and middle arched members when the helmet being deployed in its said folded inoperative position, said additional arched member being attached in a releasable attachment to said left and right arched members, thereby, when the helmet being deployed in its said operative position, said releasable attachment being employed for stopping said arched members in a spaced apart arrangement one from the other.

13. The helmet as in claim 12, further comprising a stopper deployed either at said front portions or at said rear portions for stopping said arched members in a spaced apart arrangement one from the other when deployed in their said operative positions.

14. The helmet as in claim 1, further comprising a stopper deployed either at said front portions or at said rear portions for stopping said arched members in a spaced apart arrangement one from the other when deployed in their said operative positions.

15. The helmet as in claim 1, wherein one of said left and right arched members is larger than the other of said left and right arched members, so that said left and right arched members are co-centered when the helmet is deployed in said folded inoperative position.

16. The helmet as in claim 1, wherein said left and right arched members being substantially similarly sized and curved so as said left and right arched members being coincided when the helmet deployed its said folded inoperative position.

17. The helmet as in claim 1, wherein each of said middle, said left and said right arched members has an internal surface, at least a portion of each of said internal surfaces being provided with shock-absorbent padding.

18. A collapsible helmet comprising:

(a) a left arched member and a right arched member, each of said left and right arched members having a from portion and a rear portion, said front portions of said left and right arched members being hingedly attached at a front attachment point and said rear portions of said left and right arched members being hingedly attached at a rear attachment point, thereby forming a substantially elliptic headcover, said headcover surrounding the left and the right head hemispheres of a wearer when the helmet is deployed in its operative position;

(b) a middle arched member, said middle arched member having a from portion and a rear portion, said front portion of said middle arched member being hingedly attached at said front attachment point to said left and right arched members, said rear portion of said middle arched member being hingedly attached at said rear attachment point to said left and right arched members, said middle arched member extending longitudinally across the crown of a wearer when the helmet is deployed in its said operative position so as to define a head protecting shell, wherein said middle, said left and said right arched members assume a folded inoperative position in which they overlap so that the helmet forms a compact layered, arch-shaped package in which all of said arched members circumscribe approximately half a revolution.

19. The helmet as in claim 18, further comprising at least one flexible strap connecting said middle arched member with said left and right arched members, said at least one flexible strap being stretched when the helmet is deployed in its said operative position and folded amongst any of said arched members when the helmet is deployed in its said folded inoperative position.

20. The helmet as in claim 18, further comprising an additional arched member, said additional arched member being hingedly attached via an additional attachment point to said middle arched member, said additional arched member extending laterally substantially across the crown of a wearer when the helmet is deployed in its said operative position and lying substantially aligned with said left, right and middle arched members when the helmet is deployed in its said folded inoperative position, said additional arched member being attached in a releasable attachment to said left and right ached members, such that, when the helmet is deployed in its said operative position, said releasable attachment retains said arched members in a spaced apart arrangement one from the other.

21. The helmet as in claim 18, further comprising a stopper deployed either at said front portions or at said rear portions for stopping said arched members in a spaced apart arrangement one from the other when deployed in their said operative positions.

* * * * *